US009717287B2

(12) United States Patent
DiBernardo et al.

(10) Patent No.: US 9,717,287 B2
(45) Date of Patent: Aug. 1, 2017

(54) COOLING GARMENT

(71) Applicant: Coolture LLC, Buffalo, NY (US)

(72) Inventors: Van DiBernardo, Buffalo, NY (US); Luanne DiBernardo, Buffalo, NY (US); Dale DiBernardo, North Tonawanda, NY (US); Alan Smith, New York, NY (US)

(73) Assignee: Coolture LLC, Buffalo, NY (US)

( * ) Notice: Subject to any disclaimer, the term of this patent is extended or adjusted under 35 U.S.C. 154(b) by 986 days.

(21) Appl. No.: 13/942,089

(22) Filed: Jul. 15, 2013

(65) Prior Publication Data

US 2014/0013482 A1 Jan. 16, 2014

Related U.S. Application Data

(60) Provisional application No. 61/671,452, filed on Jul. 13, 2012.

(51) Int. Cl.
*A41D 1/04* (2006.01)
*A41D 13/005* (2006.01)

(52) U.S. Cl.
CPC ..... *A41D 1/04* (2013.01); *A41D 13/0053* (2013.01); *A41D 13/0058* (2013.01)

(58) Field of Classification Search
CPC ... A41D 1/04; A41D 13/0053; A41D 13/0058
See application file for complete search history.

(56) References Cited

U.S. PATENT DOCUMENTS 2,403,676 A 7/1946 Modlinksi
3,507,321 A 4/1970 Palma
3,570,264 A 3/1971 Curtis
3,610,323 A 10/1971 Troyer
3,744,053 A 7/1973 Parker
4,170,793 A 10/1979 O'Brien
4,964,282 A 10/1990 Wagner
4,998,415 A 3/1991 Larsen
5,072,455 A 12/1991 St. Ours
5,146,625 A 9/1992 Steele et al.
5,289,695 A 3/1994 Parrish et al.
5,415,222 A 5/1995 Colvin et al.
5,484,448 A 1/1996 Steele
5,605,144 A 2/1997 Simmons
(Continued)

OTHER PUBLICATIONS http://www.polarproducts.com/polarshop/pc/Kool-Max-Zipper-Front-Vest-172p32.htm, published prior to Jul. 2012, three pages.
(Continued)

*Primary Examiner* — Shaun R Hurley
*Assistant Examiner* — Andrew W Sutton
(74) *Attorney, Agent, or Firm* — Roach Brown McCarthy & Gruber, P.C.; Kevin D. McCarthy

(57) ABSTRACT

A climate control vest having a flexible exterior layer defines a head opening area, left and right arm opening areas, a front surface, a back surface, and a belt configuration. A flexible middle layer is positioned between the flexible exterior layer and a flexible first interior layer. There is at least one pocket positioned to be over an individual's (i) front torso or lumbar areas, (ii) back torso area and (iii) back lumbar area to receive a temperature altering or control apparatus, each pocket is defined by a flexible second interior layer attached to certain portions of the flexible first interior layer except for an opening to receive the temperature altering or control apparatus.

10 Claims, 5 Drawing Sheets

(56) References Cited

U.S. PATENT DOCUMENTS

Figure 1A:
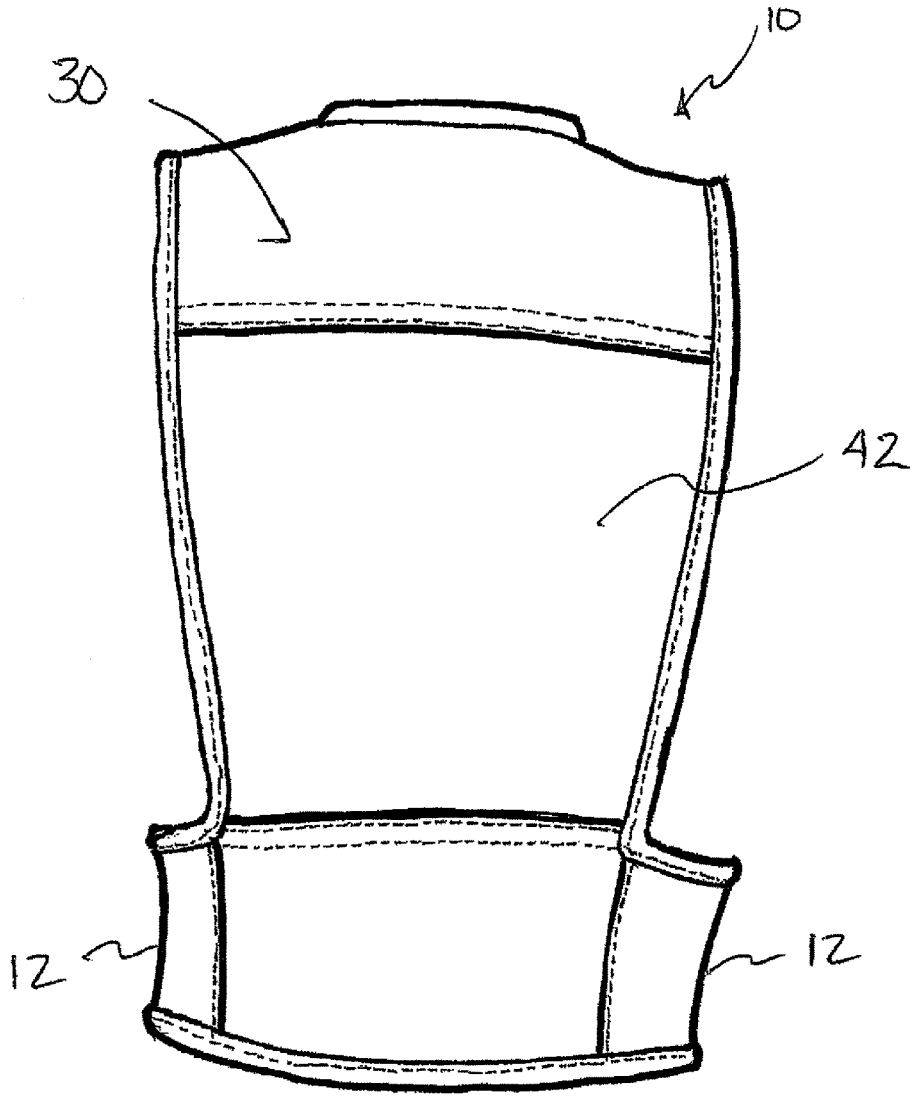

| | | | |
|---|---|---|---|
| D421,329 | S | 3/2000 | Adams |
| 6,125,645 | A | 10/2000 | Horn |
| 6,915,641 | B2 | 7/2005 | Harvie |
| 6,931,875 | B1 | 8/2005 | Allen |

OTHER PUBLICATIONS

Stacool vest products—available prior to Jul. 2012—three pages.
Steele vest products—available prior to Jul. 2012—two pages.
Silver Eagle products—available prior to Jul. 2012—three pages.

COOLING GARMENT

CROSS-REFERENCE TO RELATED APPLICATIONS

This application claims priority to U.S. provisional patent application Ser. No. 61/671,452, filed on Jul. 13, 2012.

FEDERALLY SPONSORED RESEARCH

None

SEQUENCE LISTING

None

1. FIELD OF THE INVENTION

The present invention is directed to cooling vests specifically to cool the bodies of humans or animals.

2. DESCRIPTION OF THE PRIOR ART

Body garments for the purpose of cooling appear to take many shapes and forms. Many of those body garments cool through a closed circulation system of a cool liquid through a piping network incorporated into the garment or through the specially constructed garment itself having its own circulatory network. Other cooling apparatuses cool through evaporative means. Those devices are open systems, as opposed to the closed circulation systems mentioned above, that release cool air or vapor onto and over an individual's body to cool through evaporative means. Another garment uses phase shift material in a vest to cool a person but makes no reference to the necessity of layering the phase shift material or the use of the layered phase shift material to induce air flow and remove moisture as a method of cooling by increasing the evaporation of moisture from the wearer or a means of keeping a person comfortable.

U.S. Pat. No. 3,507,321, issued to Palma on Apr. 21, 1970, discloses clothing for cooling and heating the body. Palma's clothing affects the human body from the neck down by strategically locating heating coils and cooling conduits through the clothing. U.S. Pat. No. 3,570,264, issued to Curtis on Mar. 16, 1971, discloses an evaporant cooling system comprising a light weight garment having a plurality of tubes connected in a parallel arrangement within the garment for the purposes of cooling the individual. This invention includes an inlet and an outlet manifold for circulating a liquid water-ammonia solution from a storage tank through the tubes. An exhaust port is also seen in fluid communication with the tubing for allowing the expended evaporant, the ammonia, to leave the system and further cool the individual. U.S. Pat. No. 3,610,323, issued to Troyer on Oct. 5, 1971, also discloses an evaporative cooling garment. This garment is a vest-like coat having a plurality of passageways incorporated therein to create a coat from these side-by-side passageways. These passageways are also seen as having a plurality of openings thereon. When used, the Troyer coat is supplied from a reservoir with a quantity of liquid coolant comprising water and a refrigerant through an inlet valve. As the body is cooled the refrigerant evaporates, leaves the system, and is replaced from the reservoir until the refrigerant has been depleted.

U.S. Pat. No. 3,744,053, issued to Parker on Jul. 10, 1973, discloses liquid loop garments for heating and cooling an individual. This system is a closed system, releasing no liquid or gas for either heating or cooling purposes. Parker's garment is constructed of two, liquid impervious, materials having insulation as well as other materials attached thereto. U.S. Pat. No. 4,998,415, issued to Larsen on Mar. 12, 1991, discloses a body cooling apparatus having a tubing system for circulating a fluid that is moved through the tubing within the apparatus, a compressor and a condenser in order to remove heat from the individual. U.S. Pat. No. 5,289,695, issued to Parrish et al. on Mar. 1, 1994 discloses a device for adsorbing water with a desiccant, such as calcium chloride. The exothermic heat generated by the hydration of this desiccant is blocked from the body by an open cell foam layer, for example, Thinsulate® material by 3M.

U.S. Pat. No. 4,964,282, issued to Wagner on Oct. 23, 1990, discloses a detachable bulletproof vest air conditioning apparatus. Wagner's apparatus comprises a piping system that (a) connects to a pre-cooled air source and ducts and (b) channels the air into the interior of the vest, between the vest and the individual, to cool the wearer. U.S. Pat. No. 5,146,625, issued to Steele et al. on Sep. 15, 1992, discloses a vest with cloth pockets that contain a phase shift material. The phase shift material is enclosed in sealed bags and proportionally thicken only relative to their width and thus reducing surface area to radiate heat and lengthen the freezing time required.

U.S. Pat. No. 5,072,455, issued to St. Ours on Dec. 17, 1991, discloses multiple pocketed vest with coolant packs—"a heat-intercepting shield or shroud in the form of a vest-like garment has a fabric shell within which are formed a plurality of adjacent pockets which are generally horizontal when the garment is worn. The shell has similar front and rear panel portions which cover most of the human torso. These portions each comprise two generally coextensive fabric layers which extend from the shoulder line to the bottom of the garment. These layers are stitched together to define pockets to receive replaceable packets of refreezable material which are capable of absorbing substantial quantities of heat as the material melts. Over the entire area of the pockets on both the front and back panel portions of the garment and next to the outer fabric layer are coextensive layers of non-breathable essentially-continuous reflective material and of insulating material.".U.S. Pat. No. 4,170,793, issued to O'Brien on Oct. 16, 1979, discloses a vest with a cotton inner lining which wicks moisture from the individual and allows for evaporation of moisture. U.S. Pat. No. 5,415,222, issued to Colvin et al. on Mar. 1, 1994, discloses a vest which has pouches of a coolant which does not cover the entire surface of the vest but rather allows evaporative cooling to occur where the pouches do not touch the wearer.

U.S. Pat. No. 6,125,645, issued to Horn on Oct. 3, 2000 teaches the removal of moisture by use of a cold surface. U.S. Pat. No. 6,915,641 B2 issued to Harvie on Jul. 12, 2005 discloses a mechanical compressor system that cools the body. Exothermal Tech makes a vest which has a phase change material designed to phase shift around 70° F. in a sectioned plastic bag which is encased in a cloth shell. The sections are large and run diagonally.

As identified above, the use of heating and cooling systems is disclosed in the above-identified references. More specifically, prior heating and cooling systems for heating and cooling a user are known to consist basically of familiar, expected, and obvious structural configurations, notwithstanding the myriad of designs encompassed by the numerous references which have been developed for the fulfillment of countless objectives and requirements.

In addition to the above-identified references, in U.S. Pat. No. 2,403,676; Modlinski discloses a heat and cold applicator. In U.S. Pat. No. 5,484,448; Steele describes a garment and method for cooling body temperature. In U.S. Pat. No. 5,605,144; Simmons wrote about a heating garment with pouch for accommodating inserted heating packets. In U.S. design Pat. No. Des. 421,329; Adams relates to a garment for thermal treatment. In U.S. Pat. No. 6,931,875; Allen described a vest with thermally efficient cooling of the upper torso, front and back, of a wearer. At http://www.polarproducts.com/polarshop/pc/Kool-Max-Zipper-Front-Vest-172p32.htm, Polar Products described its Kool Max vest product as "100% cotton cooling vest; Simple and unisex design with a zipper-pull front; Size is adjustable with hook and loop closures at the chest, waist, and shoulders for a snug, comfortable and customized fit; and [p]acks fit into insulated pockets inside the vest. The pockets have a comfortable all-cotton fabric to protect the skin and an insulated outer composite fabric to direct the cooling energy toward the body."

As indicated, prior cooling vests provide cooling better suited to industrial or medical environments. The fabrics common to these vests include industrial textiles, cotton canvas, cotton, spandex, and neoprene based materials. Many cooling vests are activated when immersed in cold water, then immediately worn. Many are simple, boxy constructions held to the body with exterior straps of Velcro to accommodate sizing variances.

More recent cooling vests have been identified as suited for athletics. These constructions are made from nylon fabric and are immersed in water to activate. One athletic-aimed cooling vest contains channels of gel; the entire vest is frozen before being worn.

3. SUMMARY OF THE INVENTION

A cooling vest system that thermally coolsan individual's upper torso, front and back, and back lumbar and simultaneously re-distributes the weight of the cooling system is disclosed. Such a system is particularly beneficial in alleviating the heat stress symptomatic to multiple sclerosis, COPD, heart conditions, atheletics, and burn victims.

A climate control vest having a flexible exterior layer defines a head opening area, left and right arm opening areas, a front surface, a back surface, and a belt configuration. A flexible middle layer is positioned between the flexible exterior layer and a flexible first interior layer. There is at least one pocket positioned to be over an individual's (i) front torso or lumbar areas, (ii) back torso area and (iii) back lumbar area to receive a temperature altering or control apparatus, each pocket is defined by a flexible second interior layer attached to certain portions of the flexible first interior layer except for an opening to receive the temperature altering or control apparatus.

4. BRIEF DESCRIPTION OF THE DRAWINGS

Figure 1B:
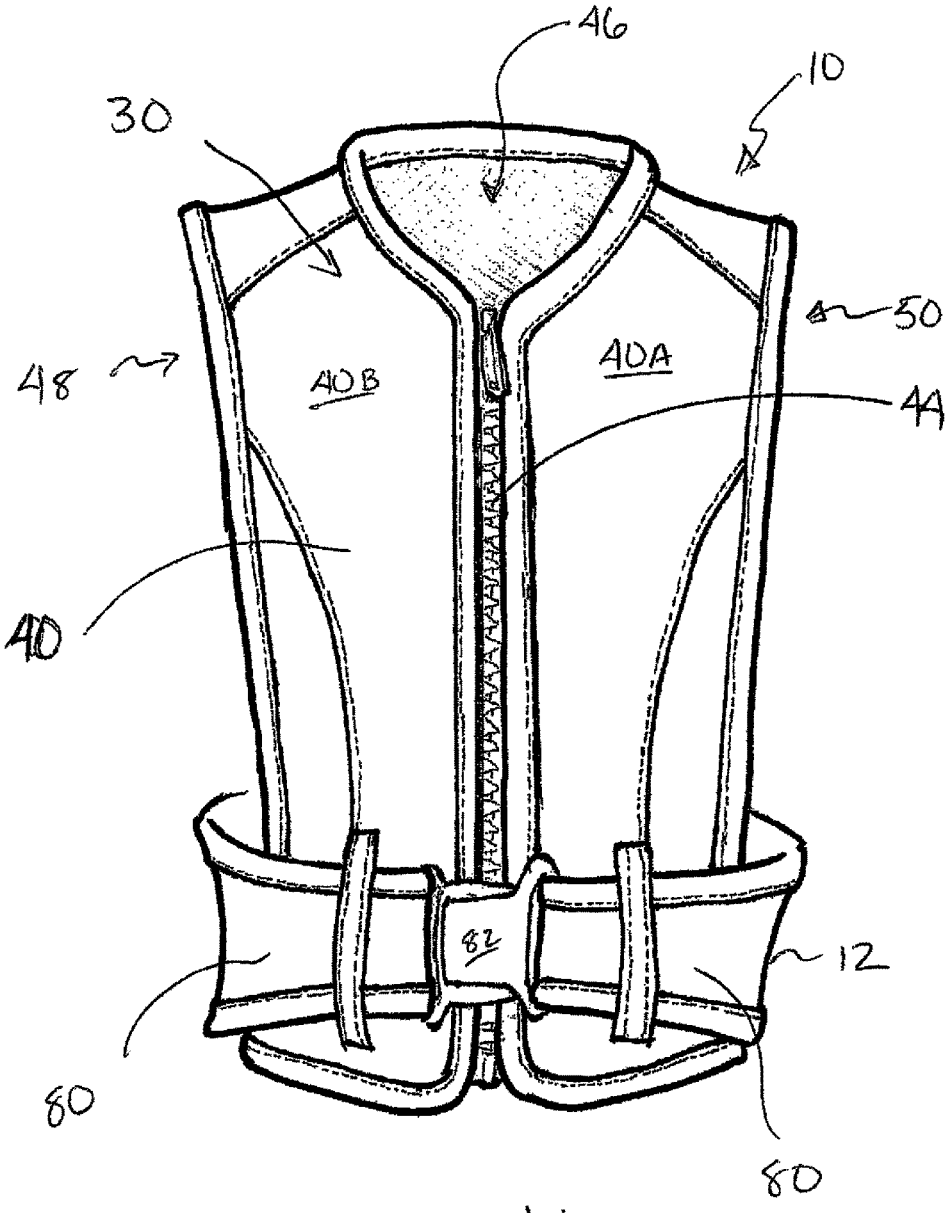
Figure 2A:
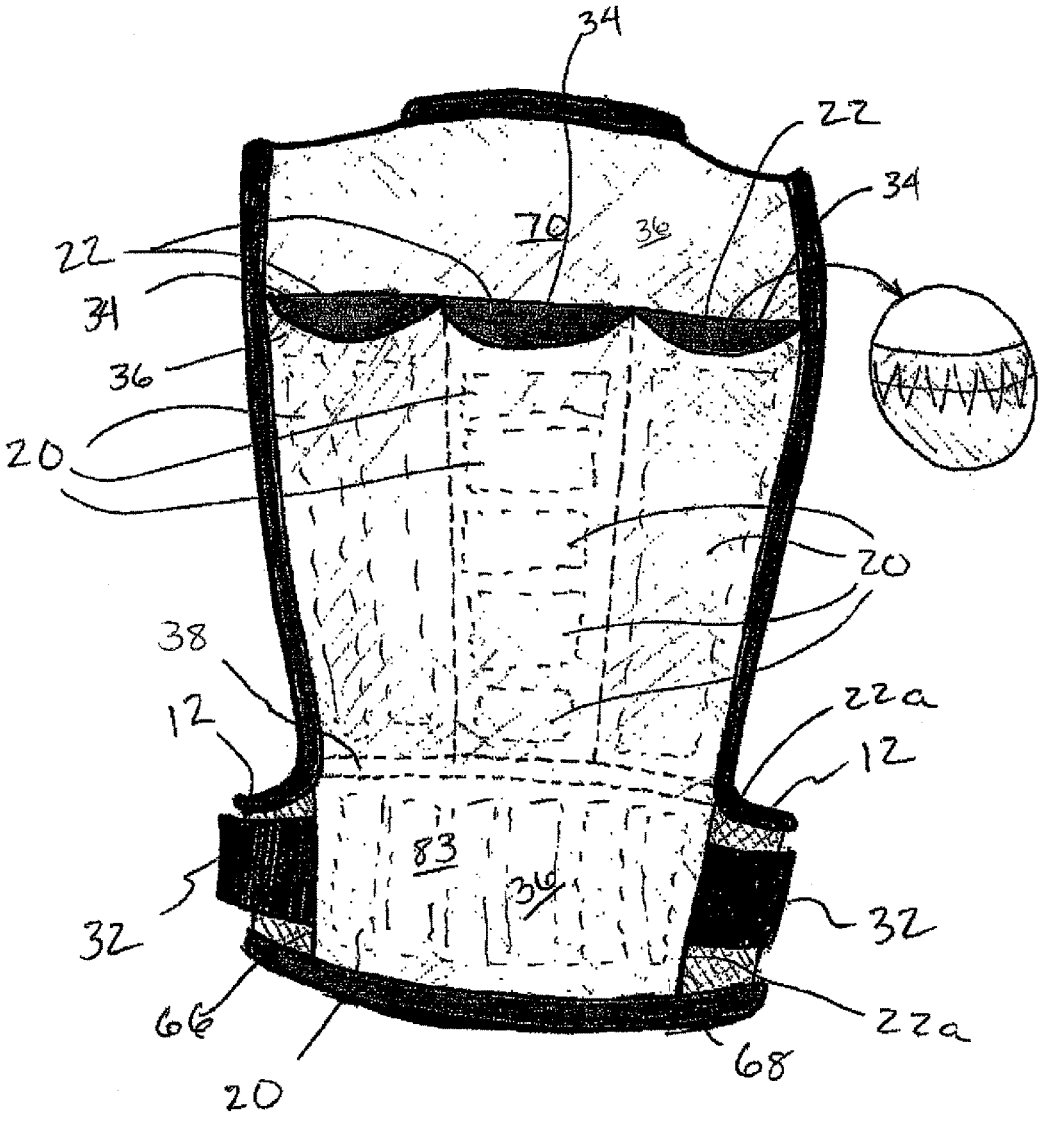
Figure 2B:
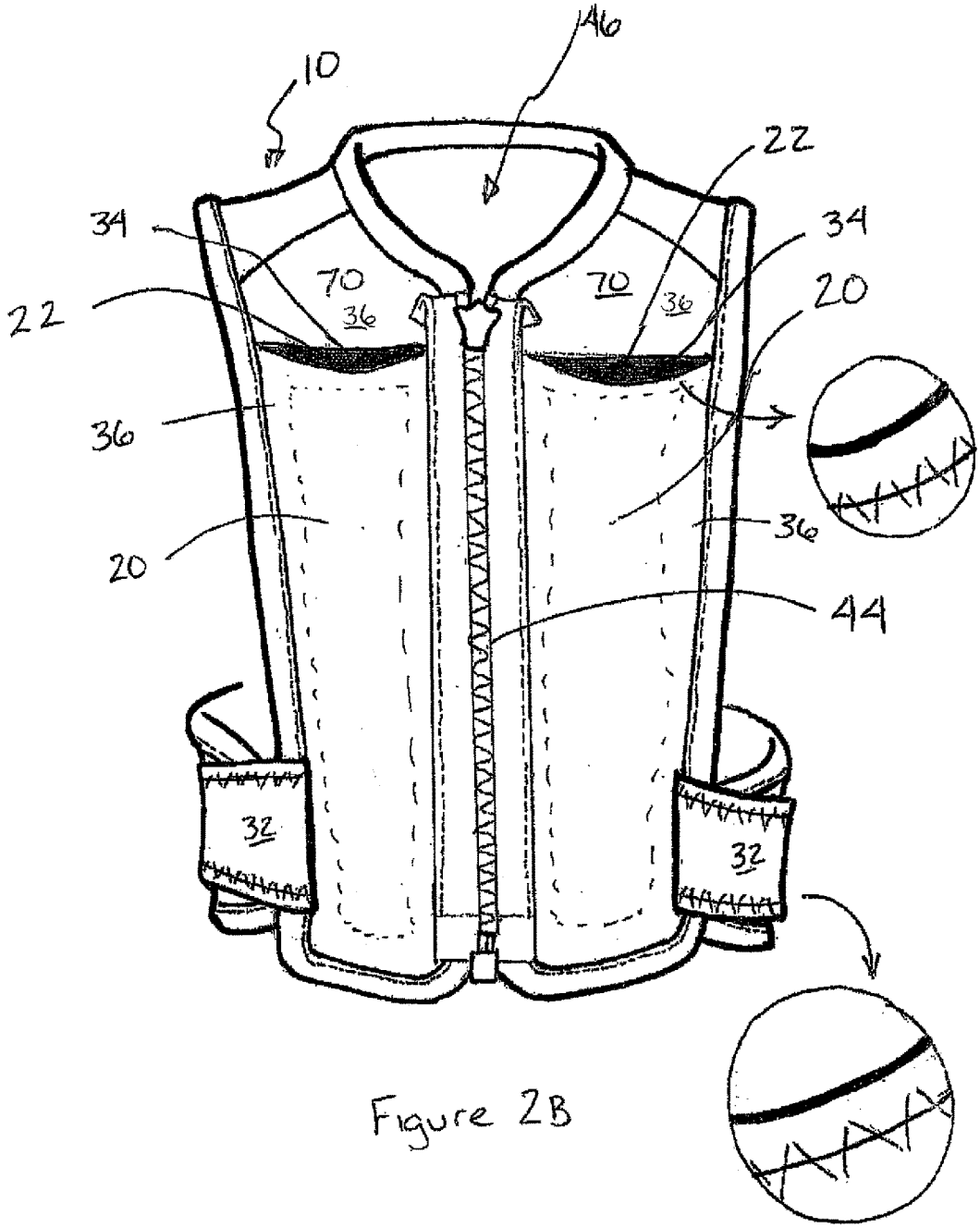
Figure 3:
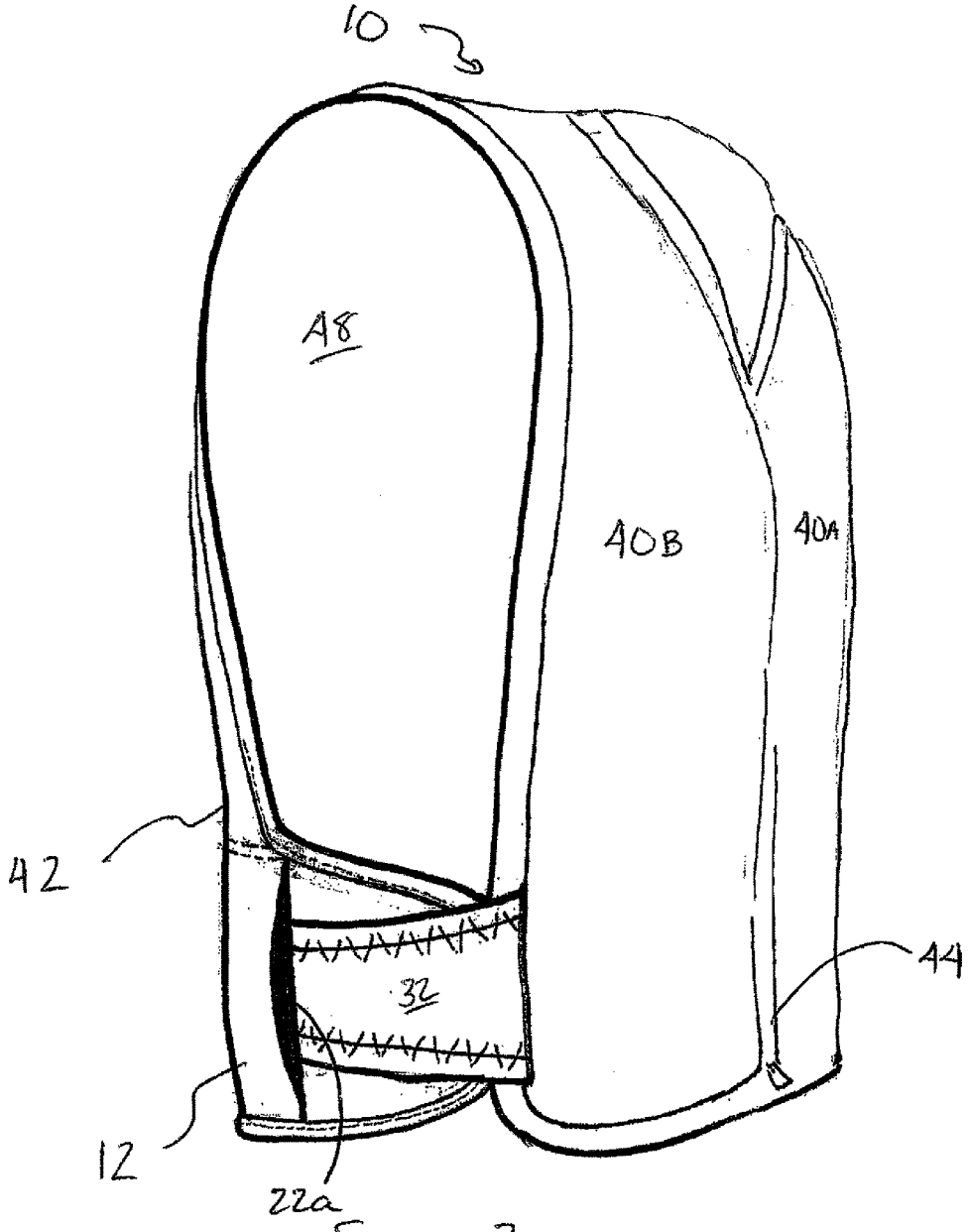

FIG. 1*a* illustrates a vest's exterior back surface and belt configuration designed to cover an individual's back torso and lumbar areas;

FIG. 1*b* illustrates the vest's exterior front surface designed to cover the individual's front torso and lumbar areas; and a belt configuration;

FIG. 2*a* illustrates a vest's interior back surface and belt configuration designed to cover the individual's back torso and lumbar areas;

FIG. 2*b* illustrates the vest's interior front surface designed to cover the individual's front torso and lumbar areas; and a belt configuration; and FIG. 3 illustrates a side view of FIG. 1*b* that illustrates the vest and the vest's right arm opening.

5. DETAILED DESCRIPTION OF THE INVENTION

The present invention is a cooling vest 10, as illustrated at FIGS. 1*a* and *b*, that is a lifestyle cooling solution for people who are compromised by heat due to chronic illness or athletics. The cooling vest 10 helps improve physical endurance when activity or environment cause the body to overheat.

The garment 10 contains high-quality athletic fabrics that provide the "apparel" appearance unique to this claimed invention. The high-tech performance fabrics work to keep the coolants colder longer without submitting the user to a shock of cold, also unique to this claimed invention.

As with any vest 10, the vest has a front surface 40 and a back surface 42. The front surface 40 (or if desired the back surface 42) may have a joining mechanism 44, for example and not limited to a zipper, togs, hook systems, laces or buttons with corresponding apertures or loops, hook and loop systems, or any other conventional joining mechanisms, that distinguishes, as illustrated, a front left surface 40*a* from a front right surface 40*b*; or no joining mechanism. In any embodiment and especially when the joining mechanism 44 joins the front left surface 40*a* to the front right surface 40*b*, the front and back surfaces 40, 42 have a head opening 46. As with any vest configuration, the vest 10 also has a right arm opening 48 (see also FIG. 3) and a left arm opening 50.

The presently claimed vest 10 provides an aesthetic solution to mandatory cooling that disperses the weight of the cooling vest through a "built-in" belt system 12 (referred to as a Weightless Belt). The Weightless Belt 12 is designed to provide a snug and comfortable cooling experience to the user. The Weightless Belt 12 assists in decreasing the burden of weight caused by, see FIGS. 2*a* and *b*, coolants 20, positioned within cavities 22 that are a part of the interior surface 70 of the vest 10, from the user's shoulders by distributing the weight throughout the user's body. The Weightless Belt 12 also assures better fit and conformation of the cooling packs to the body. Cooling is surface area dependent and the better the vest conforms to the body then the better the cooling.

The vest 10 is designed to accommodate user lifestyle: suited for work, leisure, social, or athletic environments. The vest 10 has four distinct layers—an exterior layer 30 as illustrated at FIGS. 1*a* and *b*, a middle layer 32 as illustrated at FIGS. 2*a* and *b*, and 3, and, as illustrated at FIGS. 2*a* and *b*, a first interior layer 34 and a second interior layer 36.

The exterior layer 30 provides a superior aesthetic look and simultaneously provides the desired characteristics of a synthetic blend fabric, namely Durastretch Nylon and Spandex blend by Tweave, that provides durability, stretch memory, (wicks moisture from the user), (provides desired sun reflection properties to further cool the user), or (insulates the user), where the vest is applied, from ambient environmental conditions.

The middle layer 32 is an athletic power mesh fabric, namely lycra sports power mesh, positioned between the exterior fabric 30 and the first interior layer 34. The middle layer 32 is illustrated on panels positioned between the front surface 40 and the back surface 42 to complete the definition of the right arm opening 48, as illustrated at FIG. 3, and the left arm opening 50. Similar to the exterior layer 30, the middle layer 32 wicks moisture from the user, stabilizes the garment and provides sizing flexibility.

The first interior layer 34 insulates coolants 20 from the exterior environment's heat and maintains the cooling environment positioned between the user and the first interior layer 34. The first interior layer 34 can be, for example, a layer of polyethylene terephthalate or a mixture polyethylene terephthalate and polypropylene or polyethylene terephthalate-polyethylene isophthalate copolymer, acrylic polymers, and combinations thereof. An example of the first interior layer 34 is 3M's Thinsulate material with a tricot lining. In a preferred embodiment, the first interior layer 34 is positioned between the exterior layer 30/middle area 32 and the second interior layer 36.

The second interior layer 36 is a phase change fabric. Substances that undergo the process of phase change are also known as phase change materials (PCMs). These materials store, release or absorb heat as they oscillate between solid and liquid form, giving off heat as they change to a solid state and absorbing it as they return to a liquid state. Some PCMs change phases within a temperature range that is just above and just below human skin temperature. This property now is being used in fabric and foam to store body heat and then release it when needed. PCMs in the form of microcapsules can be incorporated within fibers or foams, or may be coated onto fabrics.

Materials used may include paraffinic hydrocarbons, such as eicosane; and plastic crystals, such as 2,2-dimethyl-1,3-propanediol (DMP) and 2-hydroxymethyl-2-methyl-1,3-propanediol (DMP). When plastic crystals absorb thermal energy, the molecular structure is temporarily modified without changing the phase of the material. The thermal properties can be optimized by the choice of the paraffinic hydrocarbon. Compounds with a higher number of carbon atoms have higher temperature stability.

The inclusion of PCM microcapsules within a fiber covers a broad range of fibers including polyester, nylon, acrylics and modacrylics. The incorporation of PCMs within a fiber requires first that the PCM be microencapsulated, for example acrylic fibers containing PCMs. All of which can be purchased by manufacturers of PCM fabrics.

The various layers are joined together through conventional methods through sewing machines and thread, adhesives, sonic welding, heat sealing, or combinations thereof.

The Coolture cooling vest belt 12 construction has a cavity 22*a* that can contain a coolant 20 or a plurality of coolants 20 in the vest's 10 rear lumbar area.

The horizontal built-in belt 12 is permanently fixed (for example, sewn) to the bottom 38 of the back torso construction 42, and is not a separate accessory. From the left side seam 66 and right side seam 68 of the back torso construction 42, the belt 12 extends freely, creating independent belt straps 80 that join at the center front torso with a closure 82. The belt straps 80 are lined with loop material of conventional hook and loop attachment material (not shown) that allow the belt 12 to be lengthened or shortened as needed by user.

The lumbar section 83 of belt 12 is lined with phase change fabric 36 facing the body side, and insulating fabric, like Thinsulate® fabric, facing the environment side. Only one interior side seam is sewn closed; the opposite interior side seam is left open, creating a horizontal cavity 22*a* to encase the coolants 20 between the specialty fabrics that align the lumbar region 83.

The coolants 20 can be conventional ice or cooling packs. The ice packs can be frozen by refrigeration or by chemical reaction. Such coolants 20 can be obtained at any facility that sells such coolants.

Alternatively, the coolants 20 if desired can be replaced with heating devices that can fit within the cavities 22, 22*a*. Those heating devices can be heating packs that are warmed in, for example, an oven, by chemical reaction or if the person is willing to remain in one area, by electrical connections. Again, such heating devices can be obtained at any facility that sells such heating devices.

Thus, while there have been shown, described, and pointed out fundamental novel features of the invention as applied to a preferred embodiment thereof, it will be understood that various omissions, substitutions, and changes in the form and details of the devices illustrated, and in their operation, may be made by those skilled in the art without departing from the spirit and scope of the invention. For example, it is expressly intended that all combinations of those elements and/or steps that perform substantially the same function, in substantially the same way, to achieve the same results be within the scope of the invention. Substitutions of elements from one described embodiment to another are also fully intended and contemplated. It is also to be understood that the drawings are not necessarily drawn to scale, but that they are merely conceptual in nature. It is the intention, therefore, to be limited only as indicated by the scope of the claims appended hereto.

The invention claimed is:

1. A climate control vest comprising:

a flexible exterior layer defines (a) a head opening area, (b) left and right arm opening areas, (c) a front surface configured to cover an individual's front torso, including shoulders, and lumbar area, (d) a back surface configured to cover the individual's back torso area, and (e) a belt configuration joined to back surface and configured to cover the individual's back lumbar area and has at least one extension that extends (i) beyond one of the left or right arm opening areas and (ii) over at least a part of the front surface's flexible exterior layer to secure to another part of the belt configuration;

a flexible middle layer positioned between the flexible exterior layer and a flexible first interior layer;

at least one pocket at the vest's (i) front torso or lumbar areas, (ii) back torso area and (iii) back lumbar area to receive a temperature altering or control apparatus, each pocket is defined by a flexible second interior layer attached to certain portions of the flexible first interior layer except for an opening to receive the temperature altering or control apparatus;

wherein the flexible second interior layer is a phase change fabric, the phase change fabric is selected from the group consisting of polyester, nylon, acrylics and modacrylics and those fabrics (i) contain microcapsules containing phase change material selected from the group consisting of eicosane, 2,2-dimethyl-1,3-propanediol and 2-hydroxymethyl-2-methyl-1,3-propanediol or (ii) are coated with phase change material selected from the group consisting of eicosane, 2,2-dimethyl-1,3-propanediol and 2-hydroxymethyl-2-methyl-1,3-propanediol, the phase change material stores, releases or absorbs heat as the phase change material oscillates between solid and liquid form, giving off heat as the phase change material changes to a solid state and absorbing heat as the phase change material returns to a liquid state.

2. The climate control vest of claim 1 wherein the vest has a joining mechanism positioned between a right side and left side of the front surface.

3. The climate control vest of claim 1 wherein the vest has a joining mechanism positioned between a right side and left side of the back surface.

4. The climate control vest of claim 1 wherein the flexible exterior layer is a synthetic blend fabric that wicks moisture from the user, reflects thermal properties and is configured to insulate the individual, where the vest is applied, from ambient environmental conditions.

5. The climate control vest of claim 1 wherein the flexible middle layer is a synthetic blend fabric that is configured to absorb heat and wicks moisture from the individual.

6. The climate control vest of claim 1 wherein the flexible first interior layer is selected from the group consisting of a polyethylene terephthalate or a mixture polyethylene terephthalate and polypropylene or polyethylene terephthalate-polyethylene isophthalate copolymer and acrylic polymers, combinations thereof, with or without a tricot lining that insulates the temperature altering or control apparatus from the exterior environment's heat and maintains the desired environment to the individual.

7. The climate control vest of claim 1 wherein the flexible middle layer, the flexible exterior layer, the flexible first interior layer, and the flexible second interior layer are joined together through thread, adhesives, sonic welding, heat sealing, or combinations thereof.

8. The climate control vest of claim 1 wherein the belt configuration has (a) the at least one extension extend beyond the left arm opening, (b) a second extension that extends beyond the right arm opening, and (c) both the at least one extension and the second extension extend over at least a part of the front surface's flexible exterior layer and secure to each other.

9. The climate control vest of claim 1 wherein each pocket on the front surface and back surface has the pocket's opening positioned near the head opening area and the remainder of the pocket extending toward the lumbar covering area.

10. The climate control vest of claim 1 wherein a second pocket is on the belt configuration, and the second pocket has a second pocket opening wherein the second pocket opening is positioned toward one of the arm openings and the remainder of the second pocket extends toward the opposite arm opening.

* * * * *